United States Patent [19]

Bates

[11] Patent Number: 4,494,424

[45] Date of Patent: Jan. 22, 1985

[54] CHAIN-POWERED PIPE TONG DEVICE

[76] Inventor: Darrell R. Bates, P.O. Box 231, Thomas, Okla. 73669

[21] Appl. No.: 507,341

[22] Filed: Jun. 24, 1983

[51] Int. Cl.[3] ..... B25B 17/00

[52] U.S. Cl. ..... 81/57.18; 81/57.21; 81/57.3

[58] Field of Search ..... 81/57.15, 57.18, 57.21, 81/57.3, 57.14

[56] References Cited

U.S. PATENT DOCUMENTS

| | | | |
|---|---|---|---|
| 2,510,813 | 6/1950 | Gean | 81/57.18 |
| 2,550,045 | 4/1951 | DeHetre | 81/57.18 |
| 2,846,909 | 8/1958 | Mason | 81/57.18 |
| 3,086,413 | 4/1963 | Mason | 81/57.18 |

*Primary Examiner*—James L. Jones, Jr.
*Attorney, Agent, or Firm*—William R. Laney

[57] ABSTRACT

A chain-powered pipe tong device for spinning up and torquing drill pipe and casing when making up or disconnecting a string of tubular elements in the drilling and casing of oil wells, the tong device including a chain sprocket drivingly connected through a clutch subassembly to a gear train which drives an open centered main gear. The main gear is rotatably supported in a gear housing having an open center aligned with the open center of the main gear. The main gear and gear housing each have aligned radially opening pipe receiving slots at one side thereof. Pipe engaging dog subassemblies are mounted in the gear housing for radial reciprocation relative to the main gear and the gear housing. Each dog subassembly includes a cam rod which has one edge bearing against a V-shaped cam surface defined by the main gear. The cam rod functions for interlocking the main gear and gear housing against relative rotation in one direction at one time period during operation of the device, and also functions, in following the V-shaped cam surface, to extend pipe engaging dogs in the dog subassembly into clamping engagement with a pipe extending through the opening at the center of the main gear and the gear housing. A shifting and clutch subassembly is provided and is connected to a braking shaft which is positioned for lockingly engaging the gear train to prevent radial retraction of the pipe engaging dogs when the clutch subassembly is in a neutral position.

28 Claims, 7 Drawing Figures

CHAIN-POWERED PIPE TONG DEVICE

BACKGROUND OF THE INVENTION

1. Brief Description of the Prior Art

In running a string of drill pipe or casing into an oil and gas well, it is necessary to make up the string by threadedly interconnecting sections of the drill pipe and casing. This has been done in the past in two ways. In both methods a first section of drill pipe, which is to be connected to a second section which is held by slips in the rotary table on the drilling platform, is suspended from the mast of the derrick so that the lower end of the suspended section of pipe is immediately above, and in contact with the lower section of pipe into which it is to be threaded. In the safest, but most expensive method of threadedly engaging the pipe sections, the upper section of pipe is gripped by a power tong and is rotated about its axis by the use of such tong. The power tong is a large mechanical structure having gripping jaws which are open at one side and in the center, and which includes a geared-driven ring which forces dogs or grippers radially inwardly to clamp around the drill pipe. The gear ring-engaged dogs are then caused to undergo rotation about the axis of the pipe so that the suspended section of pipe is rotated and threaded up tightly into the section of drill pipe therebelow.

Examples of power tongs used in this way for coupling sections of drill pipe or casings are illustrated in U.s. Pat. Nos. 2,550,045, 2,573,212, 4,357,843, 1,923,010 and 1,955,727.

In U.S. Pat. No. 3,086,413, a power operated spinner mechanism is applied to a free standing section of pipe supported from the crown block swivel and is powered to spin up the pipe to a slightly tight connection to the section of pipe held in the slips on the drilling platform. A manual pipe tong is then used to tighten up the upper section by manual power to the final desired make up of the tubing string. The power operated spinner is said to be light enough to be transported from one job to another, and is universal in the sense of susceptibility to mounting upon any conventional manually operated tubing tong.

In general, power tongs of the type described include a power source which drives a gear train through which power is transmitted to a ring or ring segment which is rotated in a forward or reverse direction, depending upon whether the pipe or casing section is to be coupled (screwed up) or uncoupled (unscrewed). The ring or ring segment carries camming structures which function to cause dogs or engaging clamps or teeth to move radially inwardly against the upper pipe section which is to be coupled to a lower section. Continued movement of the ring or ring segment then causes the dogs or clamps to be rotated about the axis of the pipe, causing it to be screwed up tightly, or unscrewed, as the case may be.

Where power tongs are employed for threadedly engaging the pipe sections, there is much less risk to personnel than when manual means is utilized for making the engagement. Because of the expense of using power tongs, however, and the fact that on some types of drilling rigs, power of the correct type is not available for powering the tongs, manual means for threadedly engaging the pipe or casing sections continues to be widely employed. One of the most frequently used methods for coupling pipe sections is by use of a so-called spinning chain. In this method, one of the rig crew throws the free end of a spinning chain so as to make the chain wrap around the pipe section which is to be threaded into the next lower section. A line is then run from the spinning chain to a cat head winch. The winch is used for pulling the chain, and in pulling the chain, to cause the pipe section about which it is wrapped to undergo rotation and to become threaded into the next lower section. The use of a spinning chain to accomplish this threaded engagement is dangerous, and very frequently results in serious injuries to the chain thrower or to personnel standing near the place where the chain is used for this purpose.

Even in those instances where a spinning chain is used for effecting threaded engagement, this generally tightens the pipe joint or connection up to only a limited extent. Manual tongs are then used for applying the final torque to the pipe section to tighten it to a predetermined extent in the joint.

In U.S. Pat. No. 4,306,471, the patentee endeavors to achieve the relative economy of manually spinning up a pipe section when making a threaded connection while substantially enhancing the safety with which this method can be employed over those spinning chain methods previously in use. The inventor provides a pipe spinner apparatus which includes a pair of jaws which clamp about the pipe, and which further includes a serrated inner surface on the jaws which can grip the pipe when the jaws are closed. An outer jaw subassembly is provided to engage a chain or other flexible tension member which can be extended into engagement with the outer jaw subassembly for driving the pipe engaging elements in rotation. The chain is extended to a cat head, and it is unnecessary for workmen to throw a spinning chain or hold it in tension at the time that it is being pulled by the cat head. Thus, while a typical and conventional cat head chain device can be utilized to apply the power that rotates the pipe, there is no requirement for wrapping the chain several times about the pipe, and the workmen is isolated from the point of power application and thus can perform the method with enhanced safety.

U.S. Pat. No. 4,346,631 discloses an improved power source useful for pulling a spinning chain to initially spin up the pipe section to a relatively loosely coupled status, followed by the use of the same power device for applying force to one end of an elongated arm forming a part of a tong used to accomplish final torquing of the pipe section to achieve a tight joint. The power device employed is a piston and cylinder arrangement in combination with certain sheave devices which operate to pull the chain, and also function, at the time when final torquing is to be accomplished, to rotate the tong by coupling a cable to the end of the tong lever arm, and extending it over a suitable pulley and sheave arrangement used in conjunction with the piston and cylinder.

BRIEF DESCRIPTION OF THE PRESENT INVENTION

The present invention provides a chain powered pipe tong device which presents the advantages of a relatively mechanically simple and economical tong which can be operated and powered by the use of a chain, but which does not pose any significant hazard to operating personnel.

Broadly described, the chain powered pipe tong device of the present invention includes a chain sprocket adapted to be driven by a chain. The sprocket is drivingly connected through a clutch subassembly to a gear train which includes an open centered main gear having a segment removed from one side thereof. The main gear is rotatable relative to a gear housing or jaw plate which has an open center aligned with the open center of the main gear, and which also has a segment removed from one side thereof so that when the open segments in the main gear and the gear housing are aligned, a section of drill pipe or casing can be inserted into the open center of the main gear and the gear housing. Pipe engaging dog subassemblies are mounted in the gear housing for radial reciprocation relative to the main gear and the gear housing. Each dog subassembly includes a shaft which has one edge bearing against a chevron-shaped cam surface defined by the main gear. Each dog subassembly further includes a keeper pin for interlocking the main gear and gear housing against relative rotation in one direction, or when set to a different position prior to rotation of the main gear, for interlocking the main gear and gear housing against relative rotation in the opposite direction. The clutch assembly is connected to a locking stud which is positioned for lockingly interengaging the gear train to prevent radial retraction of the pipe engaging dog subassemblies when the clutch subassembly is in a neutral position. This assures that the pipe engaging dog subassemblies will remain in locking engagement with a pipe or casing section extended through the main gear and gear housing when the clutch subassembly is placed in the neutral position and after the dog subassemblies have been moved radially inwardly into enagagement with the pipe or casing.

The chain powered tong device of the invention further includes an elongated lever arm which projects from a housing which encloses the main gear and gear housing, and which functions to permit a high torque to be applied to a pipe section for final torquing of the pipe and completion of the joint.

An important object of the invention is to provide a relatively economically constructed chain powered pipe tong device which can be used safely by operating personnel, and which does not require manual wrapping of a chain about the pipe during spinning up a pipe section in the course of coupling it to another pipe section.

An additional object of the invention is to provide an improved chain powered pipe tong which can quickly and easily spin a pipe section up to a relatively tight threaded engagement with an adjoining pipe section, and which can then be utilized for applying a high torque to the pipe section to accomplish the final tightening of the threaded joint.

Another object of the invention is to provide a chain powered pipe tong which utilizes a chain extended to a cat head device for spinning up a section of pipe prior to final torquing, and in which the chain need not be wrapped about the pipe by a member of the drilling crew in order operate the device.

Additional objects and advantages of the invention will become apparent as the following detailed description of a preferred embodiment of the invention is read in conjunction with a perusal of the accompanying drawings which illustrate the invention.

GENERAL DESCRIPTION OF THE DRAWINGS

DETAILED DESCRIPTION OF A PREFERRED EMBODIMENT OF THE INVENTION

Figure 1:
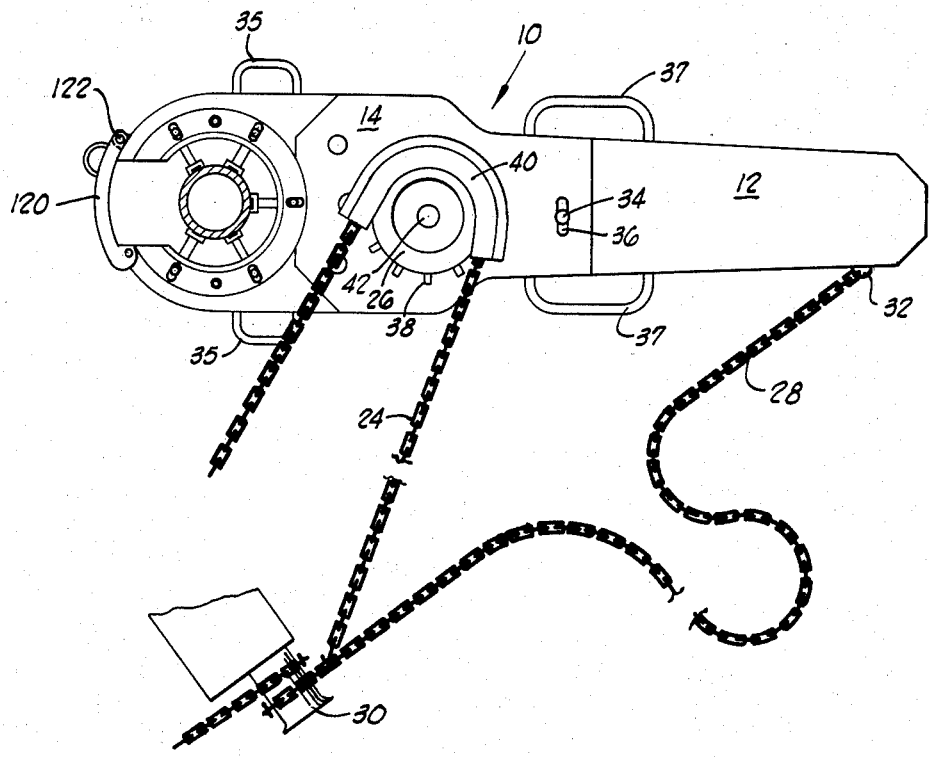
FIG. 1 is a top plan view of the chain powered pipe tong device of the invention.
Figure 2:
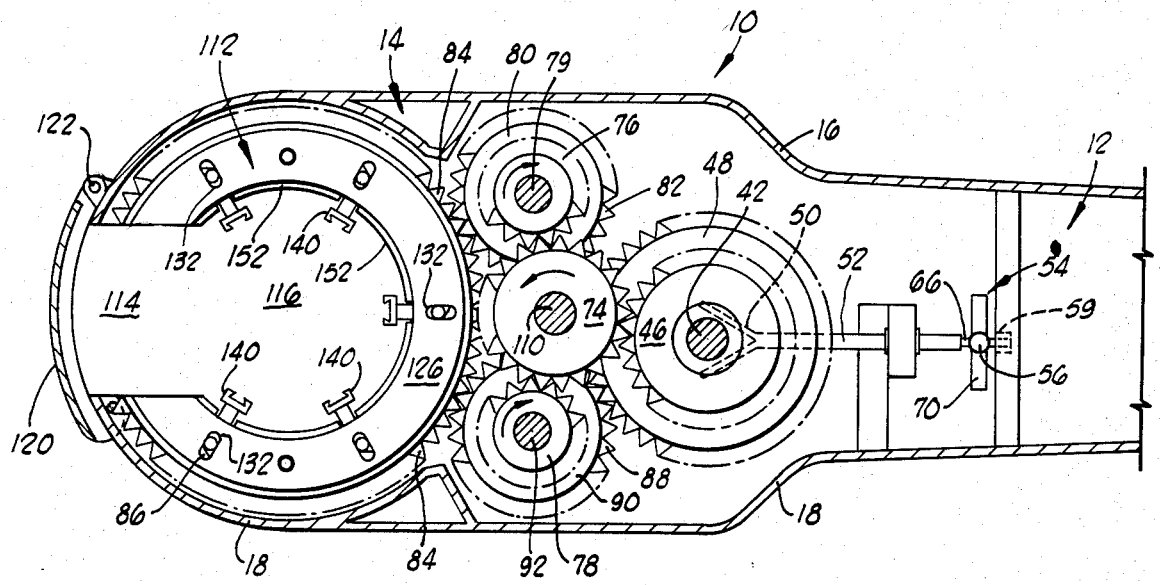
FIG. 2 is a general plan view partly in section and partly in elevation, illustrating certain parts of the gear train and drive system used in the chain powered pipe tong device of the invention.
Figure 3:
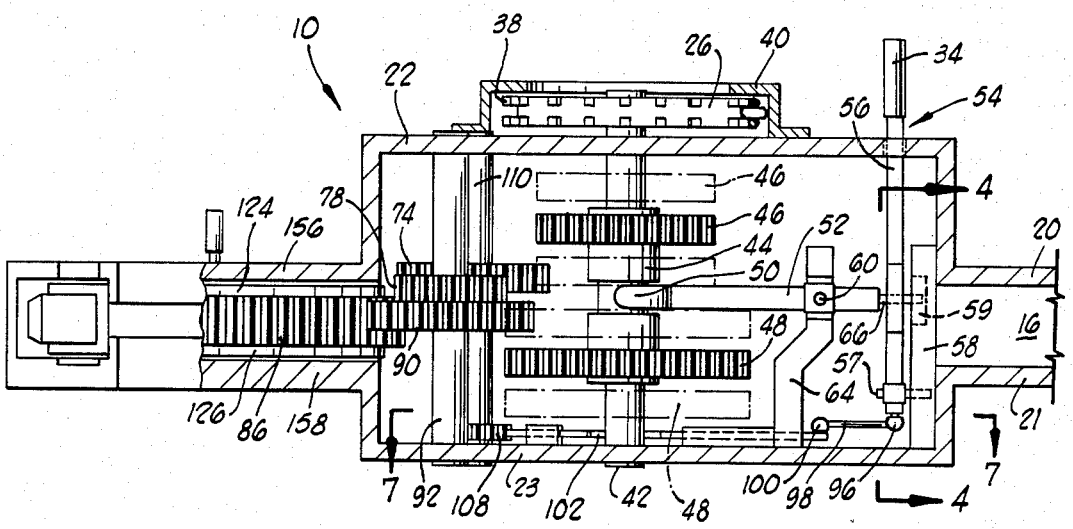
FIG. 3 is a view partly in section and partly in elevation taken along a vertical plane, and illustrating, in side elevation, certain of the gears employed in the gear train of the invention.

Referring initially to FIG. 1 of the drawings, the chain powered tong device of the invention includes a housing designated generally by reference numeral 10. The housing includes an elongated lever arm portion 12 and a pipe engaging mechanism portion 14. The housing 10 includes vertically extending side plates 16 and 18. The side plates 16 and 18 are interconnected by a top plate 20 which extends along the outer end of the lever arm portion 12, and by a bottom plate 21 which also extends along the lever arm portion. A top plate 22 and a bottom plate 23 close the central portion of the housing 10 and extend between the side plates 16 and 18 as shown in FIGS. 2 and 3. The pipe tong device further includes an elongated chain 24 which is used for spinning up pipe by driving engagement with a chain sprocket 26 which is rotatably mounted on the housing 10. A second chain 28 extends from a cat head winch 30 to a point of connection 32 to the outer end of the lever arm portion 12 of the housing 10.

An operating handle 34 projects upwardly through a slot 36 which extends transversely in the upper plate 20 of the housing 10 as shown in FIGS. 1 and 3. The housing 10 has two sets of tong lifting and manipulating handles 35 and 37 disposed on opposite sides thereof.

The chain 24 is extended into engagement with teeth 38 carried on the chain sprocket 26 at a location where the teeth and the chain are protected by means of a semi-circular chain guard plate 40 mounted on the top plate 22, of the housing 10. The chain sprocket 26 is keyed to a shaft 42 which is rotatably mounted in the top plate 22 and bottom plate 23 of the housing 10 as shown in FIG. 3. The shaft 42 has a central section which is splined for keying the shaft to a hub 44. The hub 44 carries an upper drive gear 46 and a lower drive gear 48 which is spaced downwardly from, and of relatively larger diameter than the upper drive gear 46. At a location between the drive gears 46 and 48, the hub 44 is of reduced diameter at its central portion, and receives and cooperates with a bifurcated yolk element 50 carried on one end of an elongated shaft 52 forming a part of a shifting and clutch subassembly designated generally by reference numeral 54. The gear and clutch subassembly 54 also includes, as a part thereof, the operating handle 34. The operating handle 34 includes an elongated, generally vertically projecting shifting shaft 56 which extends downwardly into the housing 10 and is pivotally mounted by means of a pivot pin 57 to a plate 58 secured within the housing.

The elongated shaft 52 which carries the bifurcated yolk element 50 at one end thereof is pivotally mounted for pivotation about a horizontal axis which crosses the shaft 52 intermediate its length. For this purpose, a pivot pin 60 is provided and is extended between opposed, spaced parallel arms carried at the opposite sides of an upwardly extending pivot bracket support element 64. The end of the shaft 52 opposite the end upon which the bifurcated yolk element 50 is mounted carries an elongated cam pin 66 which extends through a curved, generally S-shaped slot 68 formed in a cam plate 70 which is carried on the vertically projecting shaft 56 carrying the operating handle 34. The cam pin 66 further projects at its free end into a vertical slot 59 formed in the plate 58.

Figure 4:
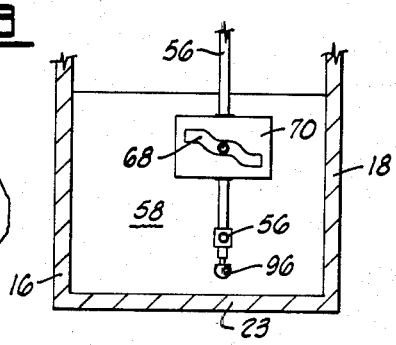
FIG. 4 is a sectional view taken along line 4—4 of FIG. 3.

The effect of this arrangement is that pivotation of the operating handle 34 so as to cause the shifting shaft 56 to pivot about the pivot pin 57 will move the cam pin 66 upwardly when the operating handle is moved to the right, as viewed in FIG. 4, downwardly when the operating handle is moved to the left, and will center the cam pin 66 when the operating handle is centered and the shaft 56 projects in the true vertical. Pivotation of the cam pin 66 in the manner described will cause the bifurcated yolk element 50 to move upwardly or downwardly, and in doing so, will cause the hub 44 to move upwardly or downwardly accordingly. This will, in turn, cause the upper gear 46 to move upwardly or downwardly and the lower gear 48 to move upwardly or downwardly, with these gears being moved between the illustrated dashed lined positions when the operating handle is pivoted fully toward the left or fully toward the right in FIG. 4. The position of the gears 46 and 48 shown in full lines is their position when the operating handle is in the neutral position in which the shifting shaft 56 projects truly vertically as it is illustrated in FIG. 4.

It will be perceived from the description which has thus far been set forth that the chain sprocket 26 is driven when the chain engaging the sprocket teeth 38 is pulled, and that rotation of the chain sprocket causes the shaft 42 to which it is keyed to undergo rotation. This in turn rotates the hub 44 and the two gears 46 and 48 which are keyed to this hub. The hub can shift upwardly and downwardly on the shaft 42 in response to the upward or downward shifting movement of the bifurcated yolk element 50 which has been explained. The gears 46 and 48 function, at different times during operation of the chain-powered pipe tong device of the invention, to transfer rotary motion to one or the other of a pair of gears included in an intermediate gear train forming a part of the invention.

Thus, though neither the gear 46 nor the gear 48 is in engagement with another gear when the device is in neutral, as such position is illustrated in FIG. 3, when the yolk element 50 is shifted downwardly, the gear 46 is moved to the lower dashed line position in which it engages a first or primary intermediate gear 74. At this time, the lower gear 48 is shifted to the lower dashed line position illustrated in FIG. 3, and is not in engagement with another gear.

By reason of engagement of the upper gear 46 with the first intermediate gear 74, the intermediate gear will be driven in a counterclockwise direction (as it is viewed in FIG. 2) when the chain is pulled to cause the chain sprocket 26 to undergo clockwise rotation. Counterclockwise rotation of the intermediate gear 74 causes each of the two secondary intermediate gears 76 and 78 with which it is engaged, as shown in FIG. 2, to rotate in a clockwise direction. The gear 76 is keyed to a shaft 79, and carried on that same shaft 79 below the gear 76 is a relatively larger gear 80 with teeth 82 which mesh with the teeth 84 of a main gear 86 (see FIGS. 3 and 6). In sum, the gear 80 is driven clockwise, as is the gear 76, by reason of common mounting on the shaft 79,, and the main gear 86 is driven in a counterclockwise direction. Concurrently, the main gear 86, is also driven in a counterclockwise direction by meshing engagement of the teeth 84 thereof with the teeth 88 carried on a gear 90 which is keyed to a shaft 92 to which the gear 78 is also keyed. In sum, counterclockwise rotation of the primary intermediate gear 74 will cause clockwise rotation of the secondary intermediate gears 76 and 78, and concurrently, clockwise rotation of the tertiary intermediate gears 80 and 90. Rotation of these gears in a clockwise direction will drive the main gear 86 in a counterclockwise direction.

In order to change the direction in which the main gear 86 is driven, the operating handle 34 is pivoted so that the shifting shaft 56, is pivoted toward the left as illustrated in FIG. 4. This has the effect of causing the bifurcated yolk element 50 to move upwardly, thereby shifting the hub 44 upwardly on the shaft 42. When this occurs, the upper drive gear 46 is disengaged from the intermediate gear 74, and the lower drive gear 48 is brought upwardly to the upper dashed line position shown in FIG. 3. In this position, the lower drive gear meshingly engages the teeth 88 of the tertiary intermediate gear 90. This direct driving engagement between the lower drive gear 48 and the gear 90 causes the gear 90 to rotate in a counterclockwise direction, and such rotation of the gear 90 will cause clockwise rotation of the main gear 86.

Before departing from a discussion of the shifting and clutch subassembly 54, it should be further pointed out that at the lower end of the vertically projecting shifting shaft 56 below the pivot pin 57, this shaft is connected through a universal ball-joint connection 96 to a horizontally extending link 98. The opposite end of the link 98 is connected through a second universal ball-joint connection 100 to one end of a sliding brake shaft 102. The sliding brake shaft 102 is reciprocably mounted in guide channels or sleeves 104 and 105 which are secured to the bottom plate 23. The opposite end of the brake shaft 102 carries a point 103 which is adapted and shaped to fit between the teeth of a brake gear 108 keyed to the lower end of the shaft 110 which carries the intermediate gear 74, which gear is also keyed to this shaft.

It will be perceived in referring to FIGS. 4 and 10 that when the operating handle 34 is shifted to either of the drive positions by pivoting the vertically projecting shifting shaft 56 to the right or to the left, (as it is viewed in FIG. 4), the effect will be to pull the horizontally extending link 98 to the right or to the left and slightly upwardly as the lower end of the shaft 56 moves to the right or to the left upon pivotation about the pivot pin 57. In either case, such movement of the horizontally extending link 98 retracts the sliding brake shaft 102 so that its end opposite the link 98 is disengaged from the teeth of the brake gear 108 carried on the shaft 110. At this time, which corresponds to either of the two drive positions of the operating handle 34 hereinbefore described, the brake gear 108 is free to rotate, as is the shaft 110, and therefore, the intermediate gear 74, which is engaged with the gears 76 and 78 can also undergo rotation. The main gear 86 thus can be driven in rotation in either a clockwise or counterclockwise direction at these times, depending upon the direction in which the operating handle 34 is shifted.

At the time when the operating handle 34 is in the neutral position so that the vertically projecting shifting shaft 56 extends straight upwardly, as shown in FIG. 4, the horizontally extending link 98 is pushed inwardly so that, at this time, the sliding brake shaft 102 is directed toward the brake gear 108 and the point 103 of the sliding brake shaft engages the teeth of the brake gear and prevents rotation of the shaft 110. Thus, the intermediate gear train is locked at this time by reason of the interengagement of the intermediate gear 74 with the gears 76 and 78 which are keyed to their respective shafts 79 and 92. Thus, in this position, the gear train is locked and the main gear 86 cannot undergo rotation in either direction. The purpose of this locking engagement will be hereinafter explained.

The main gear 86, carrying the gear teeth 84 around the outer periphery thereof, is rotatably mounted in a gear housing designated generally by reference numeral 112. Stated differently, the gear housing 112 is rotatable relative to the main gear 86. The gear housing 112 is also itself rotatably mounted within the housing 10. For this purpose any suitable bearings (not shown) can be employed.

As shown in FIG. 2, the gear housing 112 as well as the main gear 86, each have a large radial opening 114 formed in one side thereof to facilitate passage of a pipe section 136 (which is to be threadedly engaged with another pipe section) into a large central opening 116 formed through the center of both the main gear 86, and through the housing 10 and the gear housing 112. The radial opening 114 also extends through the side of the housing 10 and is formed by the termination adjacent the opening 114 of the vertically extending side plates or walls 16 and 18 of the housing. A pivoted latching door 120 is pivotally secured the side plate 18 of the housing 10 and is dimensioned to close the opening 114. The door 120 is constructed to engage a latch 122 carried on the vertically extending side plate 16 adjacent the opening 114.

Figure 5:
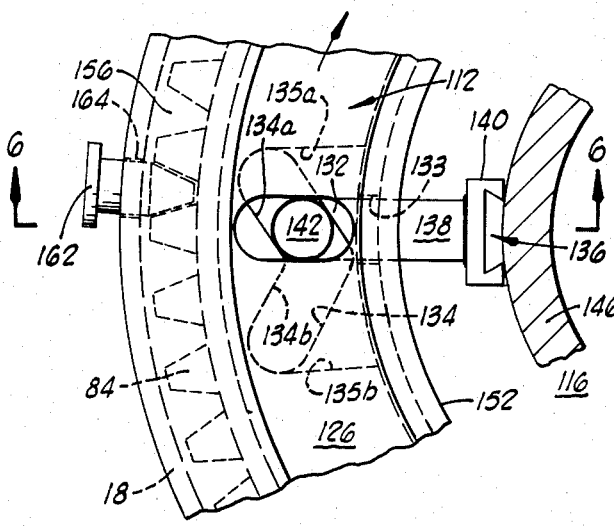
FIG. 5 is a detail view illustrating, in dashed lines, one of the cam slots formed in the main gear of the pipe tong apparatus of the invention, and further illustrating part of the gear housing which contains the main gear, and one of the dog subassemblies which is actuated by cam action when the main gear undergoes rotation relative to the jaw plate.
Figure 6:
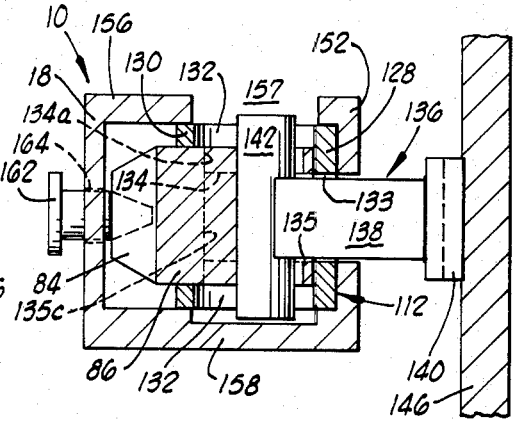
FIG. 6 is a sectional view taken along line 6—6 of FIG. 5.

As best illustrated in FIGS. 5 and 6, the gear housing 112 includes a top plate 124, a bottom plate 126, a radially inner vertically extending side wall 128 and a vertically extending radially outer side wall 130. At circumferentially spaced intervals around the gear housing 112, a plurality of elongated oval openings 132 are provided and extend radially in the top and bottom walls 124 and 126 of the gear housing. Each oval opening 132 is in radial alignment with a rectangularly shaped opening 133 formed in the radially inner wall 128 of the gear housing 112. Each elongated, radially inwardly extending oval opening 132 also overlies a pair of chevron-shaped cam slot 134 formed in the upper and lower portions of the main gear 86. The chevron-shaped cam slots 134 are circumferentially spaced around the main gear, and correspond in number and location to the location of the elongated, radially inwardly extending oval openings in the top plate 124 and bottom plate 126 of the gear housing 112. An overall view of this arrangement is depicted in FIG. 2. The chevron-shaped cam slots 134 are each characterized in having a V-shaped radially outer boundary made up of two convergent cam surfaces **134*a* and 134*b*. Each aligned pair of chevron-shaped cam slots 134 formed in the upper and lower portions of the main gear 86 communicate with a large central slot 135 in the medial portion of the main gear. Each central slot 135 is bounded by opposed, parallel side walls 135*a* and 135*b*, and by a radially outer V-shaped wall 135*c*. At its radially inner side, each of the slots 135 is open between the side walls 135*a* and 135*b* and immediately adjacent the rectangularly shaped opening 133 in the radially inner wall 128 of the gear housing 112**.

Functionally associated with each aligned pair of the chevron-shaped cam slots 134 and aligned pair of elongated oval openings 132 is a pipe engaging dog subassembly designated generally by reference numeral 136. Each pipe engaging dog subassembly 136 includes a dog shaft 138 which carries a pipe engaging dog 140 at the radially inner end thereof, and which is joined to a cam rod 142 at its other end. The cam rod 142 is a cylindrical element which has its ends projecting upwardly and downwardly through the elongated, radially inwardly extending oval openings 132 formed in the gear housing 112, and which has its central portion in contact with the V-shaped radially outer cam surfaces of the aligned chevron-shaped cam slots 134.

It will be noted in referring to the cam surface that this surface is V-shaped, with a radially innermost point or apex disposed centrally between the two oppositely directed, radially outwardly extending cam surface portions **134*a* and 134*b*. It will further be noted, in referring to FIGS. 5 and 6 that, as the main gear 86 undergoes rotative movement in relation to each cam rod 142, the cam rod bears against the V-shaped cam surfaces and is thereby forced to move in a radial direction so that the dog 140 is brought into contact with, or retracted from, a pipe section 146 which is to be gripped by the several dogs 140. Each dog shaft 138 projects through the radially inwardly facing rectangular opening 133 formed in the radially inner side wall 128 of the gear housing 112, and through a somewhat larger aligned opening 150 formed in a generally semi-circular internal side wall 152 of the housing 10. The internal side wall 152 surrounds the central opening 116, and interconnects a tong jaw top plate 156 and a tong jaw bottom plate 158 which form a part of the housing 10 at this location. As will be noted from FIG. 6, the top plate 156 has a wide slot 157 formed through the central portion thereof and extending for substantially the entire circumferential dimension of the top plate. Circumferential movement of the latching dog subassembly 136 relative to the gear housing 112 is thus prevented by the confining character of the opposite sides of the openings 133 through the radially inner side wall 128 of the gear housing 112**.

Operation

In the operation of the chain-powered pipe spinner and tong of the invention, the elongated chain 24 is first extended around the chain sprocket 26 in the manner illustrated in FIG. 1 so that it is relatively taut, and so that the links of the chain are in engagement with the teeth 38 of the sprocket. In this status, the chain is guarded from contact with the operator by the chain guard housing 40. At the time that the chain 24 is extended around the sprocket 26 in the manner described, the pipe engaging dog subassemblies 136 are in a retracted status so that the pipe engaging dogs 140 are in their radially outward position as best illustrated in FIG. 2. At this time, the gear housing 112 and the main gear 86 are aligned in a position such that the radial openings 114 in the gear housing 112 and in the main gear 86 are aligned to provide a passageway for a pipe section which is to be engaged. The chain-powered pipe spinner and tong is then moved by means of the handles 35 and 37 to a position such that a vertically extending pipe section 146, suspended from the crown block of the drilling rig, passes through the opening 114 and into the central opening 116 provided in the center of the pipe engaging mechanism portion 114 of the housing 10. In this position, the pipe section 146 is surrounded by the pipe engaging dogs 140 which are spaced radially outwardly from the pipe section.

With the pipe section 146 thus positioned, and with a link at one end of the pipe chain 24 engaged with the leverage chain 28, as shown in FIG. 1, the leverage chain in reeved about the drum of the cat head winch 30, also as shown in FIG. 1, and the winch is actuated so as to tension the elongated pipe chain 24. At this time, slack is provided in the leverage chain 28 between its point of connection 32 on the housing 10 and the point at which it is connected to the pipe chain 24. As the pipe chain 24 is drawn toward the cat head winch 30, rotation of the chain sprocket 26 occurs. Rotation of the chain sprocket 26 causes the shaft 42 to which it is keyed to undergo rotation. As viewed in FIG. 1, the sprocket 26 and shaft 42 are rotated in a clockwise direction.

Prior to the time reeling of the chain 24 upon the cat head winch 30 is commenced, the shifting and clutch subassembly 54 has been manipulated so as to place the system in a forward drive; pipe coupling status. Thus, by pushing the operating handle 34 in the proper direction, the cam pin 66 is caused to move downwardly by reason of pivotation of the shifting shaft 56 and cam plate 70 carried thereon about the pivot pin 57. As viewed in FIG. 4 of the drawings, such movement of the shifting shaft 56 and the cam plate 70 would be toward the left which would in turn cause downward movement of the cam pin 66 as it follows the S-shaped slot 68. Such movement of the cam pin 66 causes the elongate shaft 52 to pivot about the pivot pin 60, to cause the bifurcated yoke element 50 to move upwardly. Upward movement of the yoke element 50 causes the hub 44 to shift axially upwardly upon the shaft 42. This movement of the hub 44 effects a concurrent movement of the upper drive gear 46 and the lower drive gear 48 in an upward direction. The lower drive gear 48 is thereby brought into meshing engagement with the tertiary intermediate gear 90.

As will be apparent in referring to FIG. 2, driving engagement between the lower drive gear 48 and the tertiary intermediate gear 90 will drive the tertiary intermediate gear 90 in a counterclockwise direction, as viewed in FIGS. 2 and 3, when the lower drive gear 48 is driven in a clockwise direction. The lower drive gear 48 is driven in a clockwise direction by reason of the keyed connection between the lower drive gear and the hub 44, and the keyed connection of the hub to the chain sprocket shaft 42. Thus, when the chain sprocket 26 is driven in a clockwise direction, the tertiary intermediate gear 90 is driven in a counterclockwise direction through the lower drive gear 48 in the manner explained.

As the tertiary intermediate gear 90 undergoes rotation in a counterclockwise direction as viewed in FIG. 2, this gear drives the main gear 86 in a clockwise direction. The tertiary intermediate gear 90 also drives the tertiary intermediate gear 80 in a counterclockwise direction through the intervening secondary intermediate gears 76 and 78 and the first primary intermediate gear 74. The tertiary intermediate gear 80 also meshes with and drives the main gear 86 in a clockwise direction.

As the main gear 86 is driven in a clockwise direction, it will be noted in referring to FIG. 6 that the effect is to cause the chevron-shaped cam slots 134 formed in the main gear to also be moved in a clockwise direction. This movement forces each of the cam rods 142, each forming a part of the pipe engaging dogs subassemblies 136, to be forced radially inwardly due to the bearing contact of each of the cam rods 142 with the cam surface **134*a* characteristic of each of the chevron-shaped cam slots 134**.

When the cam rods 144 have been forced radially inwardly to a sufficient extent, causing concurrent radially inward movement of the associated dog shafts 138 and pipe engaging dogs 140 carried on the ends thereof, the pipe engaging dogs 140 will come in contact with the pipe section 146, and will clampingly engage the outer side of the pipe section. This movement is, of course, characteristic of each of the pipe engaging dog subassemblies 136. Thus, the pipe section 146 becomes firmly clamped between the several pipe engaging dogs 140.

This engagement of the several pipe engaging dogs 140 with the pipe section 146 occurs well prior to the time that each cam rod 142 has reached the apex or radially inner peak of the cam surface **134*a* of the respective chevron-shaped slot 134 in which the cam rod is located. The length of the cam surface 134*a* and its inclination are such that the travel which can be realized by the cam rod 142 and associated pipe engaging dog 140 prior to reaching the peak or apex of the cam surface permits the dogs 140** to reach and engage pipe sections of widely varying diameters.

After the pipe engaging dogs 140 have engaged the section of pipe 146, the cat head winch 30 continues to rotate to draw the pipe chain 24 toward the winch and to thus continue to rotate the chain sprocket 26, the shaft 42 and the lower drive gear 48. At this time, because the pipe engaging dogs 140 cannot move further radially inward, the pipe engaging dog assemblies 136 effectively act as interlocks between the main gear 86 and the main gear housing 112. This is because circumferential or lateral movement of the cam rods 142 is prevented by their close diametric fit within the width of the elongated oval openings 132 formed in the gear housing 112, and the fact that the pipe engaging dogs 140 are in contact with the pipe section 146, and therefore prevent further radially inward movement of the cam rods. Because of this interlock between the gear housing 112 and the main gear 86, continued rotation of the chain sprocket 26 at this time (as the chain 24 is reeled upon the drum of the cat heat winch 30) will cause both the gear housing 112 and the main gear 86 to rotate within the portion of the housing 10 which includes the top plate 156, the bottom plate 158, the internal side wall 152 and the side wall 18.

Continued rotation of the pipe section 146 progresses until the pipe section thus rotated is threaded up into connection with the pipe section below, which lower pipe section is suspended by slips from the rotary table. A loosely connected joint is thus made to which it is desirable to now apply a high torque force to tighten the joint further. There is employed for this purpose, the leverage which can be developed through the lever arm represented by the length of the housing 10, and particularly by virtue of the elongated lever arm portion 12 of this housing. When the loosely connected status of the pipe has been obtained by rotating the chain sprocket 26 using chain 24, the shifting and clutch subassembly 54 is shifted to a neutral position. The neutral position of the shifting and clutch subassembly 54 is that which is illustrated in FIG. 4 in which the shifting shaft 56 projects vertically, and the cam pin 56 is centered in the S-shaped slot 68.

Figure 7:
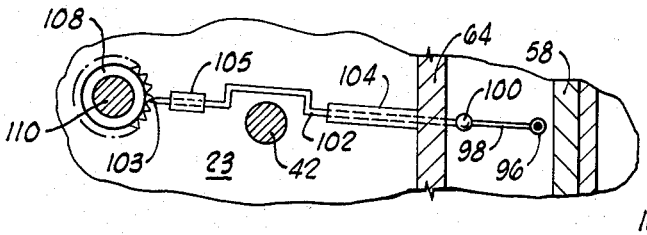
FIG. 7 is a sectional view taken along line 7—7 of FIG 3.

When the shifting and clutch subassembly 54 in this neutral position, the horizontally extending link 98 is forced to a position where it is displaced farthest toward the left as it viewed in FIG. 7 of the drawings. This position of the horizontally extending link 98 forces the brake shaft 102 also toward the left so that the point 103 on the brake shaft engages the brake gear 108 carried on, and keyed to, the lower portion of the shaft 110. This engagement of the point 103 of the brake shaft 102 with teeth carried on the brake gear 108 effectively locks the intermediate gear train, and in doing so, also locks the main gear 86 against rotation in either direction. With this locking of the main gear, the main gear cannot move relative to the gear housing 112 in a direction such that the cam rod 142 can "back-off" or move radially outwardly along the cam surface 134*a*. Thus, the pipe engaging dogs 140 cannot back away from the pipe section 146, but continue to grip the pipe section and are locked in this gripping status when the shifting clutch subassembly 54 is placed in the neutral position.

At this time, and preparatory to further torquing the pipe section 146 to tighten the threaded connection between the pipe sections to it final tightness, a locking pin 162 is inserted through an opening 164 in the side wall 18 of the housing 10 at a location where such pin will engage the teeth 84 of the main gear 84, so that the main gear 86 and housing 10 are further interlocked for common movement. When this has been accomplished, the chain 24 is detached from the chain 28 and the cat head winch 30 is utilized to reel up, and apply tension to, the leveraging chain 28. The leveraging chain 28 then applies a torquing force to the elongated lever arm portion 12 of the housing 10 via the point of connection 32 of this chain to the housing as shown in FIG. 1. The torquing force torques the pipe section 146 up to a tight threaded connection with the pipe section therebelow. The appropriate amount of torque to be applied will be understood by those skilled in the art.

After the section 146 has been torqued to a tight connection, the cat head winch 30 is deactivated, the chain 28 is slacked, the chain 24 is reconnected to a point on the chain 28 adjacent the cat head winch and the pipe chain 24 is manually pulled back to the taut status illustrated in FIG. 1 at a time when the shifting and clutch subassembly 54 is still in the neutral position. When the clutch subassembly 54 is in this position, the upper drive gear 46 and lower drive gear 48 carried thereon are disconnected from the intermediate gear train, and are in a free-wheeling status. Thus, manual pulling of the chain around the chain sprocket 26 to remove the slack therefrom can be easily accomplished. When the slack has been removed from the chain 24, and its links are in engagement with the teeth 38 of the chain sprocket 26 the locking pin 162 is removed to disengage the housing 10 from the main gear 86, and the shifting and clutch subassembly 54 is shifted into the reversing position. This is accomplished by pivoting the shifting shaft 56 to the right as it is viewed in FIG. 4. This causes the cam pin 66 to follow the S-shaped slot into the upper portion of this slot, thus depressing the cam pin and causing the yoke element 50 carried on the end of the elongated shaft 52 to pivot downwardly. This downward movement of the yoke element 50 causes the hub 44 to be shifted upwardly on the shaft 42 until the teeth of the upper drive gear 46 engage the teeth of the first or primary intermediate gear 74.

When shifting to effect this gear engagement has been accomplished, the cat head winch 30 is activated to reel in the pipe chain 24, and to cause clockwise rotation of the chain sprocket 26. Clockwise rotation of the shaft 42 to which the chain sprocket 26 is keyed will cause clockwise rotation of the upper drive gear 46. This will, in turn, cause counterclockwise rotation of the primary intermediate gear 74. Counterclockwise rotation of the gear 74 will cause the secondary intermediate gears 76 and 78 with which the gear 74 is in engagement, to undergo clockwise rotation. The secondary intermediate gears 76 and 78 are keyed to shafts 79 and 92, respectively, which also have the tertiary intermediate gears 80 and 90 keyed thereto. These gears are thus also driven in clockwise rotation and by reason of their engagement with the main gear 86 cause that gear to rotate counterclockwise. As the main gear 86 undergoes counterclockwise rotation, the effect is to cause movement of the main gear relative to the gear housing 112 in a direction such that the cam rod 142 can move radially outwardly on the cam surface 134*a*, thereby releasing the pipe engaging dogs 140 from engagement with the pipe section 146. In other words, the pipe engaging dogs are retracted to release the pipe section 146. When the cam rods 142 have reached their limit of outward radial travel, as limited by the end of the cam surface 134*a* and the radially outer terminus of the chevron-shaped cam slot 134, continued reeling up of the chain 24 by the cat head winch 30 will cause both the main gear 86 and the gear housing 112 to rotate together. Such movement is then slowly continued until these elements are brought to a position such that neither the main gear nor the gear housing obstruct the radial opening 114 in the side of the housing 10. After opening the pivoted latching door 120, the chain-powered pipe spinner and tong can then be manually pulled to one side to remove it from the pipe section 146, and to free the connected pipe section for lowering into the well.

When a return trip is being made to remove a string of pipe from downhole in a well bore, it is necessary to sequentially disconnect the several pipe sections from their threaded engagement with each other. To accomplish this, the chain-powered pipe spinner and tong of the invention is slightly altered in its status to permit it to be used in disconnecting the threadedly engaged pipe sections. To prepare the chain-powered pipe tong for unthreading the sections from each other, a pair of handles 166 are provided on the upper side of the gear housing 112, and project upwardly therefrom at locations between pairs of the elongated oval openings 132 circumferentially spaced around the gear housing. By gripping the handles 166 and rotating the gear housing 112 at a time when there is no pipe section positioned within the central opening 116, the gear housing can be caused to move relative to the main gear 86 by an amount sufficient to cause the cam rods 142 to pass along the cam surface 134*a*, over the radially inner apex or peak of this cam surface and onto the opposite cam surface 134*b* of the chevron-shaped cam slot. The movement of the dog 140 associated with the respective cam rod 142 during this shifting movement will be first a radially inward movement, and then, after the cam rod 142 passes over the peak or apex of the chevron-shaped cam slot 134 onto the cam surface 134*b*, a radially outward movement of the dog.

It will be appreciated that during this movement of the gear housing 112, effected by means of the handles 166, the shifting and clutch subassembly 54 has been placed in the neutral position which, it will be recalled, effectively locks the intermediate gear train and main gear 86 by reason of engagement of the brake shaft 102 with the brake gear 108 carried on the lower end of the shaft 110. Thus, the main gear 86 is locked against movement at the time when the gear housing 112 is being shifted to the thread uncoupling status preparatory to disconnecting interconnected pipe sections during a return trip.

After the described shifting to the disconnect status of the tool has been accomplished, the chain 24 is again pulled around the chain sprocket 26, which is now in a free-wheeling neutral status, until the chain 24 is taut. At this time, the cat head winch 30 is again activated (slack has been developed in the leveraging chain 28 at this time so that it is untensioned). Before or concurrently with energization of the cat head winch 30, the shifting and clutch subassembly 54 is shifted to a driving status.

In order to disengage the threads of coupled pipe sections, the shifting and clutch subassembly 54 is operated in the reverse direction from that which characterizes its use and operation when the pipe sections are to be threadedly engaged. Thus, in order to engage the pipe section 146 with the pipe dogs 140, and then, by continued rotational drive of the main gear 86 in the same direction, to uncouple the pipe sections, the handle 34 is grasped and the shifting shaft 56 is caused to pivot toward the right as it is viewed in FIG. 4. This movement causes concurrent movement of the cam plate 70 and the S-shaped slot 68 toward the right, and causes upward movement of the cam pin 66 as it follows the slot 68. Upward movement of the cam pin 66 depresses the bifurcated yoke element 50, and thus causes the hub 44 carrying the upper drive gear 46 to move downwardly on the shaft 42. This brings the upper drive gear 46 into meshing engagement with the first or primary intermediate gear 74. Since the chain sprocket is being driven in a clockwise direction, as viewed in FIG. 1, this causes the intermediate gear 74 to be rotated in a counterclockwise direction. The first intermediate gear 74 is in meshing engagement with the secondary intermediate gears 76 and 78 and these gears are driven in a clockwise direction by the counterclockwise rotation of the first intermediate gear 74. Clockwise rotation of the intermediate gears 76 and 78 causes concurrent clockwise rotation of the tertiary intermediate gears 80 and 90 which are carried on, and commonly keyed to, the shafts 79 and 92 which carry the gears 76 and 78, respectively.

Clockwise rotation of the gears 80 and 90 drives the main gear 86 in a counterclockwise direction. Counterclockwise rotation of the main gear 86 forces the cam rods 142 radially inwardly as they follow the cam surface 134*b*. Thus, the dogs 140 are brought into clamping engagement with the pipe section 146. Since the cam rods 142 can then undergo no further radially inward movement, the cam rods effectively interlock the main gear 86 with the gear housing 112. Both are then concurrently rotated by reason of the driving connection to the main gear 86 from the chain sprocket 26. As both the gear housing 112 and main gear 86 undergo counterclockwise rotation, the pipe section 146 is disengaged from the next lower pipe section.

After the pipe engaging dogs 140 have clamped against the pipe section 146 by reason of the drive imparted to the main gear 86 from the chain sprocket 26, the shifting and clutch subassembly 54 is placed in the neutral position in which the pipe dogs 140 are lockingly engaged with the pipe section 146, and the intermediate gear train is locked against rotation by reason of the engagement of the point 103 of the brake shaft 102 with the brake gear 108. This prevents the main gear 86 from backing off and releasing the pipe dogs 140 from their engagement with the pipe section 146. The chain 24 can then be slacked (the chain sprocket 26 is now in a free-wheeling status), and the locking pin 162 is inserted to lock the housing 10 to the main gear 86. The leverging chain 28 can be reeled in upon the cat head winch 30 to apply a high torque to the pipe by means of the leverage obtained by applying a force to the end of the elongated lever arm portion 12 of the housing 10. This will break the high torque connection of the threaded pipe sections, and permit subsequent rapid unscrewing of the pipe sections by use of the pipe chain 24. In other words, once the pipe connection has been broken out by the high leverage developed using the chain 28, the chain 24 can again be reeled around the sprocket 26 while the sprocket is in a free-wheeling status. The shifting and clutch subassembly 54 is then again shifted to the unthreading position by moving the shifting shaft 56 toward the right, as it is viewed in FIG. 4, to elevate the elongated cam pin 66 and depress the yoke element 50. This will cause the hub 44 to slide downwardly on the shaft 42 and once again engage the upper drive gear 46 with the first intermediate gear 74. As previously explained, this will cause the main gear 86 to undergo counterclockwise rotation, retaining the pipe engaging dogs 140 in tight engagement with the pipe section 146. The total disengagement of the threaded connection between pipe section 46 and the next lower pipe section in the string can then be rapidly effected. This occurs as the main gear 86 and the gear housing 112 undergo concurrent mutual rotation.

After the pipe section 146 has been disengaged from the next lower pipe section, the pipe engaging dogs 140 can be retracted to release the pipe section by throwing the shifting and clutch subassembly 54 to effect reverse rotation of the main gear 86. This is accomplished by pivoting the shifting shaft 56 to the left, as it is viewed in FIG. 4. This movement causes the yoke 50 to pivot upwardly, moving the hub 44 upwardly, and concurrently, shifting the upper drive gear 46 and the lower drive gear 48 upwardly to the dashed line positions illustrated in FIG. 3. In this position, the lower drive gear 48 engages the tertiary intermediate gear 90, and this driving engagement permits the clockwise rotation movement of the chain sprocket 26 to be translated through the intermediate gear train to a clockwise drive of the main gear 86. When the main gear 86 is driven in a clockwise direction, such movement occurs relative to the gear housing 112 which has a slightly greater resistance to rotative movement than does the main gear 86, thus permitting the cam rod 142 to move radially outwardly along the cam surface 134*b*, and thus permitting the dog shaft 138 and the pipe engaging dog 140 carried on the end thereof to retract and release the pipe section 146. Continued rotation of the chain sprocket 126, when the shifting clutch subassembly is in this status, will shortly cause concurrent rotation of the main gear 86 and the gear housing 112. This concurrent movement is used to return both of these structural elements to a status such that the opening 114 is unobstructed, and the released pipe section 146 can be removed from the central opening 116 through the chain-powered pipe spinner and tong of the invention.

From the foregoing description of the invention, it will be perceived that a relatively inexpensive, mechanically reliable and highly useful tool is provided for the purpose of spinning up and tightening to a tight joint, sections of threaded drill pipe or casing as the same are being lowered in a vertical string into a well bore. The tool is very safe to use, posing no hazard to operating personnel.

Although a preferred embodiment of the invention has been herein described, changes and innovations can be made in the described and illustrated structure without departure from the basic principles which underlie the invention. Changes and modifications of this type are therefore deemed to be circumscribed by the spirit and scope of the invention except as the same may be limited by the appended claims or reasonable equivalents thereof.

What is claimed is:

1. A chain-powered pipe tong device comprising:

an elongated main housing including a lever arm portion adjacent one end of the housing and a pipe engaging mechanism portion defining a pipe opening extending through the main housing, and defining a radial opening at one side of the pipe engaging mechanism portion communicating with the pipe opening;

an annular gear housing rotatably mounted in the main housing and having a central opening therethrough aligned with said pipe opening in the main housing, said gear housing further defining a pipe admitting radial opening at one side thereof communicating with said gear housing central opening, and said gear housing further defining a plurality of radially inwardly opening pipe dog ports communicating with the central opening in said gear housing;

an annular main gear rotatably mounted within said gear housing and having a central opening therethrough aligned with the central opening in said gear housing, and further having a pipe admitting radial opening at one side thereof communicating with the central opening in said main gear, said main gear having gear teeth around the outer periphery thereof, and said main gear defining a plurality of circumferentially spaced cam slots;

pipe gripping dog subassemblies mounted in said gear housing and each including a cam rod, and dog means connected to said cam rod, each of said cam rods cooperating with one of said cam slots, and each of said dog means being positioned for extension through one of said pipe dog ports at a time during relative movement between the respective cam rod connected thereto and one of said cam slots;

a chain sprocket rotatably mounted on said main housing and accessible on the outer side of said main housing;

a two directional intermediate gear train positioned between, and drivingly interconnecting, said chain sprocket and said main gear for selectively driving said main gear in a clockwise or counterclockwise direction when said chain sprocket is driven in one direction;

a shifting and braking subassembly mounted in said main housing, and including means for alternately shifting said intermediate gear train from a clockwise driving status to a counterclockwise driving status, and for alternately placing said intermediate gear train in a neutral status in which rotation of said chain sprocket does not drive said main gear, said shifting and braking subassembly further including means for locking said main gear against rotation relative to said main housing; and a drive chain drivingly connected to said chain sprocket.

2. A chain-powered pipe tong device as defined in claim 1 and further characterized as including a tong leveraging chain connected to the lever arm portion of said main housing.

3. A chain-powered pipe tong device as defined in claim 1 and further characterized as including means for incrementally shifting the position of said gear housing relative to said main gear to bring the cam rods of said dog subassemblies into contact with selected portions of the respective cam slots.

4. A chain-powered pipe tong device as defined in claim 1 and further characterized as including:

a pair of drive gears connected to said chain sprocket for rotation therewith, and mounted for selective shifting movement into and out of engagement with selected gears in said intermediate gear train; and wherein said shifting and braking subassembly comprises:

an elongated shifting shaft mounted pivotally in said main housing;

a yoke element connected to said shifting shaft for movement in first and second opposite directions on opposite sides of a neutral position when said shifting shaft is shifted in opposite directions from a neutral position; and means supporting said pair of drive gears for said shifting movement, and responsively engaged by said yoke element to be shifted in a first direction and then in a second and opposite direction when said yoke element moves, respectively, in said first and second opposite direction.

5. A chain-powered pipe tong device as defined in claim 1 wherein said shifting and mounting subassembly means for locking said main gear against rotation comprises:

an elongated shifting shaft pivotally mounted on said main housing for pivotation about an axis of pivotation intermediate its length;

brake linkage means connected to the end of said shifting shaft and mounted on said main housing for undergoing reciprocating movement when said shifting shaft is pivoted; and a braking gear connected to a part of said intermediate gear train in driving engagement with said main gear, and engageable with said brake linkage at one time during the reciprocation thereof to then arrest further movement of said braking gear, said intermediate gear train and said main gear.

6. A chain-powered pipe tong device as defined in claim 5 wherein said brake linkage means comprises:

a horizontally extending link;

a first universal joint connecting one end of said link to said shifting shaft;

a brake shaft having a first end and having a second end;

a second universal joint connecting the first end of said brake shaft to said link;

means carried on the second end of said brake shaft for arrestingly engaging the braking gear; and sleeve means secured to said housing and slidingly and reciprocably receiving said brake shaft.

7. A chain-powered pipe tong device as defined in claim 1 wherein each of said cam slots is of chevron-shaped configuration and is bounded by a radially outer side of V-shaped configuration having a pointed apex at its radially innermost point whereby in cooperating with one of said cam slots, one of said cam rods is cammed in a radially inward direction in moving toward said pointed apex along said outer side when said main gear is rotated relative to said annular gear housing, and said dog means is moved toward a pipe extending through the central openings in said main gear and gear housing.

8. A chain-powered pipe tong device as defined in claim 1 wherein said dog means comprises:

a pipe engaging dog; and a dog shaft interconnecting said pipe engaging dog and said cam rod.

9. A chain-powered pipe tong device as defined in claim 3 wherein said means for incrementally shifting the position of the gear housing relative to said main gear comprises a handle carried on the gear housing for rotating said gear housing relative to the main gear.

10. A chain-powered pipe tong device as defined in claim 1 wherein said gear housing includes a plurality of circumferentially spaced, oval, elongated radially extending slots each aligned with one of the cam slots in said main gear, and each guidingly receiving a portion of one of said cam rods for guiding the received cam rod portion into a radial movement when said main gear is rotated relative to said gear housing.

11. A chain-powered pipe tong device as defined in claim 1 wherein said device is further characterized as including:

a drive shaft keyed to said chain sprocket for rotation therewith;

a hub keyed to said drive shaft for rotation therewith, and mounted slidably on said drive shaft for axial shifting movement thereof along said drive shaft;

a first drive gear keyed to said hub for rotation therewith and shiftable with said hub on said drive shaft;

a second drive gear keyed to said hub and spaced from said first drive gear on said hub, said first and second drive gears being mounted for engagement of said first drive gear with said intermediate gear train when said second drive gear is disengaged therefrom, and for engagement of said second drive gear with said intermediate gear train when said first drive gear is disengaged therefrom.

12. A chain-powered pipe tong device as defined in claim 4 wherein said means supporting said pair of drive gears comprises;

a drive shaft extending from said chain sprocket and keyed thereto for rotation therewith; and a hub slidingly mounted on said drive shaft for axial movement therealong, and keyed to said drive shaft for rotation therewith, said hub having said pair of drive gears mounted thereon for rotation therewith.

13. A chain-powered pipe tong device as defined in claim 10 wherein each of said cam slots is of chevron-shaped configuration and is bounded by a radially outer side of V-shaped configuration having a pointed apex at its radially innermost point whereby in cooperating with one of said cam slots, one of said cam rods is cammed in a radially inward direction in moving toward said pointed apex along said outer side when said main gear is rotated relative to said annular gear housing, and said dog means is moved toward a pipe extending through the central openings in said main gear and gear housing.

14. A chain-powered pipe tong device as defined in claim 13 wherein said cam slots are arrayed in circumferentially spaced pairs with the cam slots in each pair being formed in respectively opposite sides of said main gear, and in alignment with each other and with said oval radially extending slots in said gear housing.

15. A chain-powered pipe tong device as defined in claim 14 wherein said main gear further includes a plurality of circumferentially spaced central slots, each of said central slots being disposed in said main gear between the chevron-shaped cam slots in one of said pairs of said cam slots, each of said central slots having two opposed parallel bounding side walls separated by a distance substantially equivalent to the greatest width of each of said cam slots, and opening at the radially inner side of said annular main gear.

16. A chain-powered pipe tong device as defined in claim 15 wherein said dog means includes:

a dog shaft having one end connected to one of said cam rods, said dog shaft extending radially through said central slot and having a second end lying radially inwardly of said annular main gear; and 17. A chain-powered pipe tong device as defined in claim 2 and further characterized as including means for incrementally shifting the position of said gear housing relative to said main gear to bring the cam rods of said dog subassemblies into contact with selected portions of the respective cam slots.

18. A chain-powered pipe tong device as defined in claim 17 and further characterized as including a pair of drive gears connected to said chain sprocket for rotation therewith, and mounted for selective shifting movement into and out of engagement with selected gears in said intermediate gear train; and wherein said shifting and braking subassembly comprises:

an elongated shifting shaft mounted pivotally in said main housing;

a yoke element connected to said shifting shaft for movement in first and second opposite directions on opposite sides of a neutral position when said shifting shaft is shifted in opposite directions from a neutral position; and means supporting said pair of drive gears for said shifting movement, and reponsively engaged by said yoke element to be shifted in a first direction and then in a second and opposite direction when said yoke element moves, respectively, in said first and second opposite direction.

19. A chain-powered pipe tong device as defined in claim 6 and further characterized as including means for incrementally shifting the position of said gear housing relative to said main gear to bring the cam rods of said dog subassemblies into contact with selected portions of the respective cam slots.

20. In a pipe tong device for threadedly engaging pipe sections, and having a plurality of pipe engaging elements, a rotatable gear element, and means cooperating with the gear element to extend the pipe engaging elements into engagement with a pipe, the improvement which comprises:

a chain driven rotary element;

a plurality of driving gears selectively drivingly connected between said chain driven rotary element and said rotatable gear element; and a shifting and braking subassembly for shifting said driving gears between forward drive, reverse drive and neutral positions, said shifting and braking subassembly comprising:

a shifting shaft including an operating handle at one end thereof;

a yoke element connected to two of said driving gears for shifting one of said two driving gears into a position of forward driving engagement relative to said rotatable gear element when said yoke moves in a first direction, for shifting the other of said two driving gears into a position of reverse driving engagement with said rotatable gear element when said yoke moves in a second direction, and for disconnecting both of said two driving gears from said rotatable gear element when said yoke is placed in a selected position;

means connecting said yoke elements to said shifting shaft for moving said yoke in a selected direction when said operating handle is moved; and a brake shaft connected to said shifting shaft and lockingly connectable to said rotatable gear element when said shifting shaft is moved by movement of said operating handle to move said yoke element to said selected position.

21. The improvement in a pipe tong device as defined in claim 20 and further characterized as including:

a hub having said two driving gears secured thereto and having said yoke engaged therewith; and a gear shaft extending into said hub and being splined and keyed thereto to facilitate axial movement of said hub on said gear shaft, and to facilitate rotary motion of said hub and said two driving gears with said gear shaft, said gear shaft having said chain driven rotary element connected thereto for driving said gear shaft in rotation.

22. The improvement in a pipe tong device as defined in claim 20 wherein said means connecting said yoke element to said shifting shaft comprises:

a slotted, motion directing guide plate secured to said shifting shaft, and having an S-shaped slot formed therein;

a yoke shaft projecting from said yoke element toward said guide plate; and means extending from said yoke shaft into said S-shaped slot and movable together with said yoke shaft in a plane in first one direction, and then in the opposite direction, when the shifting shaft and the slotted, motion directing guide plate mounted thereon are moved first in one direction and then the other.

23. The improvement in a pipe tong device as defined in claim 20 wherein said two driving gears include:

a first drive gear connected to said chain driven rotary element for mutual rotation therewith;

a second drive gear connected to said chain driven rotary element for mutual rotation therewith, said first and second drive gears being said two driving gears to whlch said yoke element is connected;

a primary intermediate gear positioned for engagement by said first drive gear upon selective shifting of said yoke element;

a pair of secondary intermediate gears drivingly engaged with said primary intermediate gear; and a pair of tertiary intermediate gears connected to said secondary intermediate gears for mutual rotation therewth, said tertiary intermediate gears drivingly engaging said rotatable gear element, and one of said tertiary intermediate gears positioned for engagement by said second drive gear upon selective shifting of said yoke element.

24. The improvement in a pipe tong device as defined in claim 23 wherein said means connecting said yoke element to said shifting shaft comprises:

a slotted, motion directing guide plate secured to said shifting shaft, and having an S-shaped slot formed therein;

a yoke shaft projecting from said yoke element toward said guide plate; and means extending from said yoke shaft into said S-shaped slot and movable together with said yoke shaft in a plane in first one direction, and then in the opposite direction, when the shifting shaft and the slotted, motion directing guide plate mounted thereon are moved first in one direction and then the other.

25. The improvement in a pipe tong device as defined in claim 23 and further characterized as including:

a hub having said two driving gears secured thereto and having said yoke engaged therewith; and a gear shaft extending into said hub and being splined and keyed thereto to facilitate axial movement of said hub on said gear shaft, and to facilitate rotary motion of saif hub and said two driving gears with said gear shaft, said gear shaft having said chain driven rotary element connected thereto for driving said gear shaft in rotation.

26. The improvement in a pipe tong device as defined in claim 25 wherein said means connecting said yoke element to said shifting shaft comprises:

a slotted, motion directing guide plate secured to said shifting shaft, and having an S-shaped slot formed therein;

a yoke shaft projecting from said yoke element toward said guide plate; and means extending from said yoke shaft into said S-shaped slot and movable together with said yoke shaft in a plane in first one direction, and then in the opposite direction, when the shifting shaft and the slotted, motion directing guide plate mounted thereon are moved first in one direction and then the other.

27. The improvement in a pipe tong device as defined in claim 20 and further characterized as including:

a housing rotatably containing said rotatable gear element and said means cooperating with the gear element; and means for interlocking the housing and the rotatable gear element against movement relative to each other.

28. A chain-powered pipe tong device comprising:

an elongated main housing including:

an elongated lever arm portion adjacent one end of the housing; and a generally annular pipe engaging portion adjacent the opposite end of the main housing, said pipe engaging portion defining a pipe receiving central opening extending therethrough, and a radial pipe passing opening in one side thereof communicating with said central opening;

an annular gear housing rotatably mounted within the pipe engaging portion of the main housing and defining a pipe receiving central opening aligned with the central opening in the pipe engaging portion of the main housing, and further defining a radial pipe passing aperture in one side thereof, said gear housing having:

a top plate having circumferentially spaced oval openings therethrough;

a bottom plate having circumferentially spaced oval openings therethrough in alignment with the oval openings in the top plate; and a radially inner side wall around said central opening and extending between said top plate and said bottom plate, said radially inner side wall having said circumferentially spaced rectangular dog shaft openings therethrough, with each of said dog shaft openings in radial alignment with the oval openings in said top plate and said bottom plates; and a radially outer side wall extending between said top plate and said bottom plate and spaced radially outwardly from said radially inner side walls;

an annular main gear rotatably mounted within said gear housing and defining a central opening aligned with the central opening in said main gear and the central opening in said pipe engaging portion of said main housing, and a radial opening at one side thereof for admitting a pipe section to said central opening therethrough, said main gear having a plurality of circumferentially spaced pairs of aligned chevron-shaped slots formed in opposite sides thereof with the chevron-shaped slots in each pair of such chevron-shaped slots in alignment with a pair of said oval openings in the top plate and bottom plate of the gear housing, said main gear further including a central slot disposed between the chevron-shaped slots in each pair thereof, said central slots each having opposed parallel side walls separated from each other by a distance substantially equal to the largest width dimension of each of said chevron-shaped slots;

a pipe gripping dog subassembly associated with each of said pairs of chevron-shaped slots in the respective intervening central slot, and mounted in said main gear for movement therewith, said pipe gripping dog subassembly comprising:

a cam rod extending through the associated aligned pair of chevron-shaped slots, the central slot between said associated pair of chevron-shaped slots and through said aligned pair of oval openings in the gear housing, with said cam rod in bearing contact with a V-shaped defining side of each of the chevron-shaped slots in the associated pair of said chevron-shaped slots;

a dog shaft projecting radially inwardly from said cam rod through said central opening and through one of said dog shaft openings; and a pipe engaging dog carried on said radially inner end of said dog shaft opposite its end secured to said cam rod;

a chain sprocket adapted for rotation by said chain; and a gear train drivingly connected between said chain sprocket and said main gear for driving said main gear in rotation within said gear housing to thereby cause said pipe gripping dog subassemblies to be actuated and force the cam rods, dog shafts and pipe engaging dogs forming parts of each of said pipe gripping dog subassemblies in a radially inward movement for purposes of engaging a pipe, or, alternately and selectively, in a radially outward movement, for disengaging said pipe engaging dogs from a pipe extended through the central openings in said gear housing and said main gear.

* * * * *

UNITED STATES PATENT AND TRADEMARK OFFICE

CERTIFICATE OF CORRECTION

PATENT NO. : 4,494,424

DATED : January 22, 1985

INVENTOR(S) : Darrell R. Bates

It is certified that error appears in the above-identified patent and that said Letters Patent are hereby corrected as shown below:

Column 9, line 12, change "114" to --14--.
Column 18, line 37, change "; and" to --.--.

Signed and Sealed this

*Twenty-eighth* Day of *May 1985*

[SEAL]

*Attest:*

DONALD J. QUIGG

*Attesting Officer* *Acting Commissioner of Patents and Trademarks*